US006123392A

United States Patent [19]

Alfred et al.

[11] Patent Number: 6,123,392

[45] Date of Patent: Sep. 26, 2000

[54] CHIROPRACTIC ADJUSTING CHAIR

[76] Inventors: Jeff R. Alfred, 2050 S. Woodlands Village Blvd., Flagstaff, Ariz. 86001; Teresa G. Alfred, 4110 E. Roadrunner La., Flagstaff, Ariz. 86004

[21] Appl. No.: 09/515,040

[22] Filed: Mar. 6, 2000

Related U.S. Application Data

[63] Continuation of application No. 09/273,504, Mar. 22, 1999, abandoned.

[60] Provisional application No. 60/085,527, May 14, 1998.

[51] Int. Cl.[7] ..... A47C 7/50

[52] U.S. Cl. ..... 297/466; 297/423.17; 297/423.1; 297/423.12

[58] Field of Search ..... 297/466, 195.11, 297/423.12, 423.17, 423.37, 344.18, 423.1

[56] References Cited

U.S. PATENT DOCUMENTS

| | | | |
|---|---|---|---|
| D. 286,822 | 11/1986 | Opsvik . | |
| D. 291,155 | 8/1987 | Wertheimer . | |
| D. 292,853 | 11/1987 | Opsvik . | |
| D. 294,545 | 3/1988 | Opsvik . | |
| D. 295,119 | 4/1988 | Gusrud . | |
| D. 299,594 | 1/1989 | Richardson . | |
| D. 348,568 | 7/1994 | Landry . | |
| 485,277 | 11/1892 | Hunter | 297/466 |
| 4,065,180 | 12/1977 | Karay | 297/466 |
| 4,192,546 | 3/1980 | Smith | 297/466 |
| 4,300,249 | 11/1981 | Taylor | 297/423.17 X |
| 4,431,234 | 2/1984 | Lacey | 297/466 X |
| 4,542,936 | 9/1985 | Gafken . | |
| 4,930,842 | 6/1990 | Wilkinson et al. | 297/466 |
| 5,040,522 | 8/1991 | Daniels | 297/466 X |
| 5,342,116 | 8/1994 | Walton | 297/466 |
| 5,758,892 | 6/1998 | Hogan | 297/466 X |
| 5,806,929 | 9/1998 | Choi | 297/466 X |

FOREIGN PATENT DOCUMENTS

| | | | |
|---|---|---|---|
| 115768 | 4/1956 | France | 297/466 |

*Primary Examiner*—Peter M. Cuomo
*Assistant Examiner*—Rodney B. White
*Attorney, Agent, or Firm*—Richard C. Litman

[57] ABSTRACT

A chiropractic adjusting chair includes bracing for restraining lateral movement of the legs of a person seated thereon, for aiding in the manipulation of various areas of the spine of a patient by a chiropractor, therapist, or other health professional. The chair includes a base (which may be adjustable for height), a seat, and a pair of adjustable extensions for generally immobilizing the legs. The extensions are preferably adjustably mounted to the underside of the seat portion such that they are adjustable longitudinally and arcuately in horizontal and vertical planes. The forward or distal end of each extension is provided with a padded brace for holding the lower extremities of the patient. The extensions are then adjusted to limit the movement of the patient's lower extremities, thereby stabilizing the lower body during the spine or upper body manipulation procedure and precluding or greatly reducing rotation of the legs and pelvic areas of the patient. The braces at the distal ends of the extensions may comprise various forms, such as generally L, U, or circular configurations, as desired and depending upon the degree of leg restraint desired.

20 Claims, 4 Drawing Sheets

CHIROPRACTIC ADJUSTING CHAIR

REFERENCE TO RELATED PATENT APPLICATIONS

This application is a continuation of U.S. patent application Ser. No. 09/273,504, filed Mar. 22, 1999, now abandoned and claims the benefit of U.S. Provisional Patent Application Ser. No. 60/085,527, filed on May 14, 1998.

BACKGROUND OF THE INVENTION

1. Field of the Invention

The present invention relates generally to chairs and the like for seating or supporting a person, and more specifically to a chair for use by chiropractic professionals for facilitating manipulation of the vertebrae of a patient. The patient is seated in the present chair, and leg restraining means stabilize the lower extremities to preclude their lateral rotation when the upper body and spine are therapeutically rotated.

2. Description of Related Art

Chiropractic therapy has enjoyed ever increasing popularity as people have discovered its benefits. A common chiropractic procedure is the torsional manipulation of the sacral, lower lumbar, and thoracic regions of the spine, wherein the upper torso of the patient is twisted or turned to the left and right while the hips and lower body are held relatively stationary.

Traditional examination tables have not been designed for the specific stabilization of the lower body for manipulations of this type. For this reason, chiropractors are often taught to have their patients wrap their legs around the legs of the examination table in an effort to prevent movement of the lower extremities along with the torso. While this method is functional, it depends largely upon the patients ability to stabilize his or her own lower body, and does not help those patients who are not able to contort their bodies in such a way.

Accordingly, a need will be seen for a chiropractic adjusting chair which includes means for stabilizing the hips and lower extremities of a patient seated therein, for precluding rotational motion thereof. This allows the upper body to be rotated or twisted relative to the lower body for therapy of the spine and associated muscles and structure, while the lower portion of the body of the patient is held relatively stationary by the present chair. A discussion of the related art of which the present inventor is aware, and its differences and distinctions from the present invention, is provided below.

U.S. Pat. No. 4,542,936 issued on Sep. 24, 1985 to David M. Gafken, titled "Chiropractor's Examination Chair," describes A generally H-shaped frame having a fixed circular chair at one juncture of the frame, and a second chair secured to the crossmember to swing in a horizontal arc about its attach point with the crossmember. No means of restraining lateral movement of the legs is provided by the Gafken chair, whereas the present chiropractic adjusting chair provides lateral retaining means for precluding lateral leg motion of a patient seated in the chair. Also, the present invention comprises only a single seating surface, with the chiropractor using a separate seat or chair or remaining up and mobile for manipulation of the patient as required.

U.S. Pat. No. D-286,822 issued on Nov. 25, 1986 to Peter Opsvik, titled "Combined Rocking Chair And Kneeler," illustrates a design for a kneeling type chair, in which a pair of knee or shin pads are positioned in front of a seating surface. The user sits upon the seating surface with the knees or shins resting upon the knee or shin pad portions of the chair. A pair of rockers extends forwardly from beneath the seating surface, with one of the knee pads disposed at the raised end of each rocker. No lateral restraining means is provided for the legs of a person using the Opsvik rocking kneeling chair, and the instability of the rocking chair is not suitable for use as a chiropractic chair.

U.S. Pat. No. D-291,155 issued on Aug. 4, 1987 to Roger Wertheimer, titled "Orthopedic Chair," illustrates a design for a kneeling type chair supported by casters beneath the frame. The knee or shin pads extend upwardly from two of the frame members, but no lateral restraint means is provided for the legs of a person using the Wertheimer chair, whereas the present chair provides such lateral restraint means for precluding movement of the lower body of a patient during chiropractic manipulation.

U.S. Pat. No. D-292,853 issued on Nov. 24, 1987 to Pewter Opsvik, titled "Chair," illustrates a design for a kneeling type chair supported on four fixed legs. The rear legs support a seating surface, while the front legs support a single lateral knee or shin support. The knee or shin support and seat are connected by a central brace. No lateral leg restraining means is provided by opsvik for his chair design.

U.S. Pat. No. D-294,545 issued on Mar. 8, 1988 to Peter Opsvik, titled "Seat Cushion And Support Unit For A Combined Seat And Kneeler," illustrates a design for a castered unit apparently having a connector extending forwardly from the frame thereof. Only the seating portion is illustrated; no knee or shin supports or pads are shown, much less any lateral restraint means for the legs of a person seated or braced thereon.

U.S. Pat. No. D-295,119 issued on Apr. 12, 1988 to Svein A. Gusrud, titled "Chair," illustrates a design having a seating surface and knee support surface. The remarks of the Gusrud disclosure state that the chair has a "lower supporting member to engage the shins of the user", but no lateral restraining means for the legs of a person using the Gusrud chair, is apparent.

U.S. Pat. No. D-299,594 issued on Jan. 31, 1989 to Beverly J. Richardson, titled "Therapeutic Posture Chair," illustrates a design for a kneeling type chair having two separate shin supports. While the shin supports have slightly concave surfaces for greater comfort, they do not include any means for precluding lateral movement of the upper or lower legs or shins when the upper body is turned or twisted, whereas the present chiropractic adjusting chair includes such leg braces or stops for the legs of a person seated in the present chair.

U.S. Pat. No. D-348,568 issued on Jul. 12, 1994 to Sylvain Landry, titled "Chair," illustrates a design for a kneeling type chair having a single lateral shin or knee support, similar to the chair disclosed in the Opsvik '853 U.S. Design Patent discussed further above. While the Landry chair appears to provide some adjustment of various components thereof, no lateral restraining means for the legs is provided by Landry for his chair.

German Patent Publication No. 2,728,062 published on Jan. 11, 1979 describes (according to the English abstract) a chair with an adjustable footrest. The schematic nature of the drawings do not indicate any form of lateral retaining means for the legs of a person seated on the chair.

Finally, European Patent Publication No. 17,450 published on Oct. 15, 1980, titled "A Sitting Device," describes a kneeling type chair having rockers, somewhat similar to the chair disclosed in the '286 U.S. Design Patent to Opsvik, who is one of the co-inventors shown in the '450 European Patent Publication. As in the '286 U.S. Design Patent, no lateral leg retaining means is provided in the '450 European Patent Publication, whereas such leg retaining means is a part of the present chiropractic adjustment chair invention.

None of the above inventions and patents, either singly or in combination, is seen to describe the instant invention as claimed.

SUMMARY OF THE INVENTION

A chair for aiding in the manipulation of the vertebrae of the spine of a patient by a chiropractor, therapist or other health professional includes a base, a seat, and a pair of adjustable extensions for retaining the legs of a person seated thereon and precluding lateral movement of his or her legs. The extensions are mounted to the underside of the seat portion such that they are adjustable in three dimensions. The forward end of each extension is provided with a padded brace which is used to engage the lower extremities of the patient. The extensions are then adjusted to limit the movement of the lower extremities, thereby stabilizing the lower body during the manipulation. Movement of the lower body, and particularly the legs and pelvic areas, is precluded or greatly reduced while the mid-section and torso are rotated or otherwise manipulated in adjusting vertebrae from the lumbar to the thoracic regions.

The padded braces of the present chair may take many forms including a simple right angle brace that limits lateral movement. A U-shaped brace may be used to limit movement laterally and longitudinally or vertically, depending upon its placement relative to the leg of a person in the chair. A sleeve-like brace may also be used, and is beneficial if pivotally mounted to the extension.

Accordingly, it is a principal object of the invention to provide a chiropractic adjusting chair for stabilizing the lower body to facilitate adjustment and manipulation of the vertebrae of a person seated in the chair.

It is a further object of the invention to provide a chiropractic adjusting chair including a pair of extensions or arms for bracing the legs of a person seated on the chair, for precluding substantial lateral movement of the legs.

It is another object of the invention to provide a chiropractic adjusting chair which extensions may be adjustable longitudinally and arcuately in vertical and horizontal planes, as desired.

Yet another object of the invention is to provide a chiropractic adjusting chair which leg restraining extensions include leg restraining braces at their distal ends.

Still another object of the invention is to provide a chiropractic adjusting chair which leg restraining braces may comprise L-, U-, or circular restraining elements for securing adjacent or about the legs of a person seated on the chair, with the brace elements being padded as desired for the comfort of a person using the present chair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
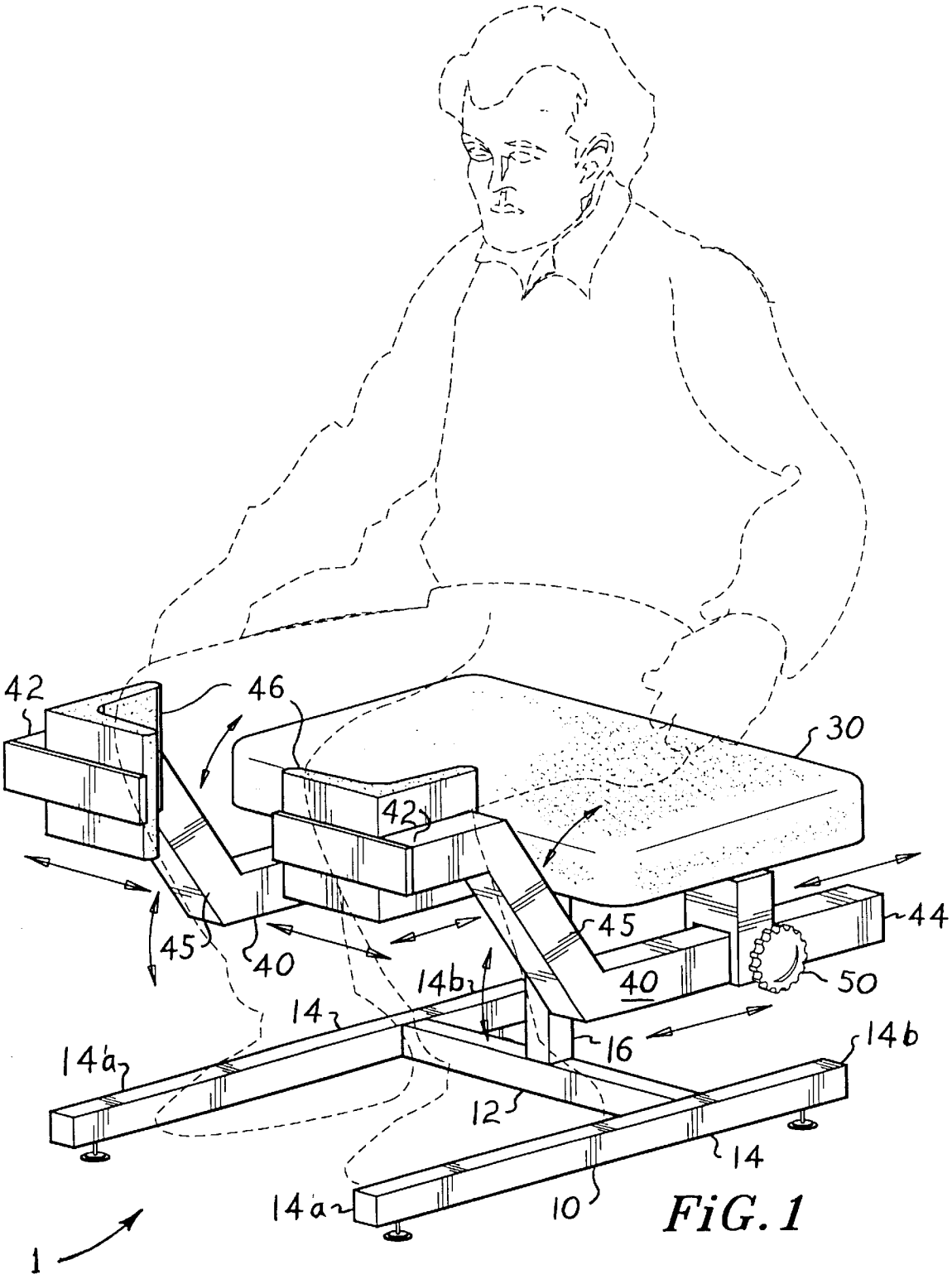
FIG. 1 is an environmental, perspective view of the present chiropractic adjusting chair, showing its use and operation.

The present invention comprises a chiropractic adjusting chair for use in restraining or precluding lateral movement of the legs and pelvic areas of the body of a patient seated thereon, during torsional manipulation of various areas of the spine and/or upper body by a chiropractor, physical therapist, or other health professional. The present chair is designated by the reference numeral 1 throughout the drawing Figures, and is shown in use in FIG. 1 of the drawings. The chair 1 includes a base 10 having a generally H-shaped platform, a seat portion 30, and two adjustable arms 40. The base 10 may include a section for a power lift (either electronic or hydraulic) and a section for a weight to hold the base 10 in place.

The cross brace 12 of the H-shaped base 10 extends between the two parallel legs 14, but the forward leg portions 14*a*, i. e., those leg portions disposed forwardly of the crossmember 12, are somewhat longer than the opposite rearward leg portions 14*b*. A generally vertical seat post or pedestal 16 extends upwardly from the center of the cross brace 12, to support the seat portion 30 thereon. The seat support pedestal 16 may be adjustable (by power or manual means) in height if so desired, for adjustment to a wide variety of patient sizes. Such height adjustment means may be conventional, e. g., with the pedestal 16 comprising telescoping tubular members with a series of lateral adjustment passages therethrough, through which a lateral stop pin or the like is inserted at the desired position to maintain the height adjustment as desired. Other height adjustment means (e. g., a helically threaded screw shaft threaded into a mating fitting, etc.) may be provided as desired.

With the cross brace 12 being positioned rearwardly of the center of the base 10, the seat post 16 is thus also disposed rearwardly, thus positioning the seat portion 30 somewhat rearwardly of the vertical center of the chair 1 assembly. The base 10 and seat support pedestal assembly 16 may be made of any material suitable for supporting the weight of a seated patient. Although the choice of materials is great, tubular steel (square, round, etc.) is a preferred construction material.

The seat portion 30 of the chair 1 is mounted to the upper end of the seat support post 16. The seat 30 has no back, in order to allow the chiropractor or health care professional complete access to the torso of a patient seated on the chair. The seat 30 itself is preferably padded or upholstered and rectangular in shape, but may be any suitable shape or configuration. The seat 30 has a width substantially equal to the width of the H-shaped base 10 and is centrally disposed upon the support post 16. As the support post 16 is offset toward the rear of the base frame 10, it will be seen that the seat 30 installed thereon is also offset toward the rear of the frame 10. The rear edge of the seat 30 is positioned approximately over the rearward ends 14*b* of the legs 14 of the base 10, with the forward edge of the seat being positioned somewhat rearwardly of the forward ends 14*a* of the legs 14. The lower portion of the seat 30 is sufficiently strong to support the patient's weight as well as to allow mounting of the extensions 40 to the seat portion 30.

A pair of extension arms 40 are used to stabilize the lower extremities of the patient using the present chair 1 during spinal manipulation. The extensions 40 are mounted to either side or end of the underside of the seat 30. Each extension 40 extends forwardly approximately the same distance as the forward legs 14*a* of the H-shaped base 10, and rearwardly about the same distance as the rear legs 14*b* of the base 10. The extensions 40 may also be provided with a bend or offset 45 that raises the forward end 42 upward to the level of the seat 30 when the chair base 10 is resting upon a generally level surface. The extensions 40 are adjustable longitudinally and arcuately in horizontal and vertical planes, relative to the chair 10. This range of movement assures a comfortable fit regardless of the size of the patient. This also allows the chiropractor or health care professional to have a wide range of stabilizing points for the legs of the patient seated in the chair 10, ranging from the lower thigh to the ankle if necessary. Once the extensions 40 are adjusted, they are secured in place by a locking mechanism 50, which may be a tightening knob or lever which clamps against the generally horizontal portion of the extensions 40 to secure them in place as desired.

Each extension arm 40 has two ends 42 and 44. The first or forward end 42 is provided with a padded brace 46 for engaging the lower extremities of the patient, e. g., near the knee. The padded brace 46 may take several forms, with examples shown in FIGS. 2A through 2C. Regardless of form, the pad 46 provides comfort and protection from bruising to the patient during the spinal adjustment. The forward end 42 of each arm 40 is adjusted (which may be facilitated by handles located at the forward ends 42), according to the chiropractor's and patient's needs for a particular adjustment, to hold the lower extremities of the patient to preclude any significant lateral movement of the legs or pelvic area of the patient so that the patient's back may be twisted without having the lower body follow the movement. In the embodiment of FIG. 2B, the brace comprises a right angle brace 46*a* attached to the inner surface of the distal end 42 of each extension 40; the opposite right side brace and extension (not shown( will be seen to be a mirror image to the left side shown in FIG. 2B. The right angle brace 46*a* limits the amount of forward and outward (lateral) movement each leg may exhibit. By adjusting the extensions 40 longitudinally, (i. e., adjusting the extensions 40 so the padded braces 46*a* are closer to the seat portion 30), the amount of forward movement of the legs of a patient seated on the present chair 1 may also be limited. The right angle padding may be limited to a short length, or extend substantially the entire length of the forward portion of the distal end 42 of the extension 40 as seen in FIG. 2*b*.

Figure 2A:
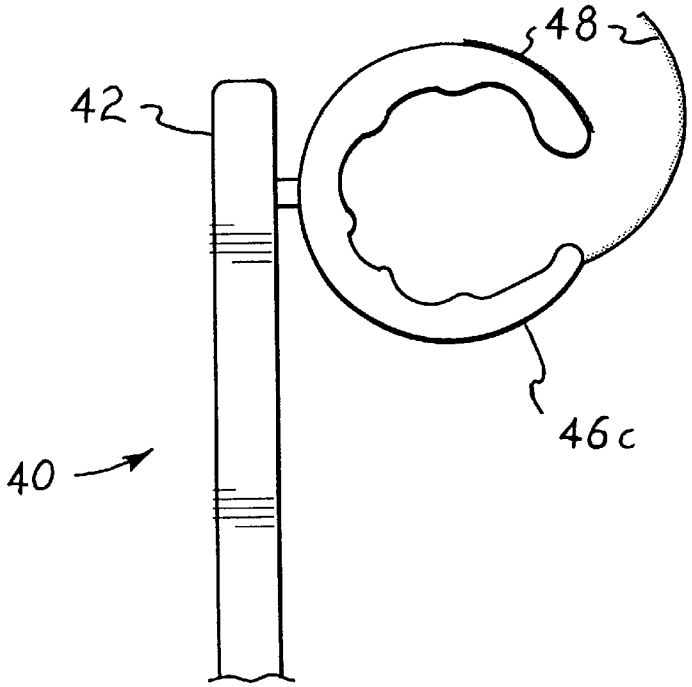
FIG. 2A is a top plan view of the distal portion of a leg restraint extension or arm used with the present chair, showing a sleeve-type padded brace thereon.
Figure 2B:
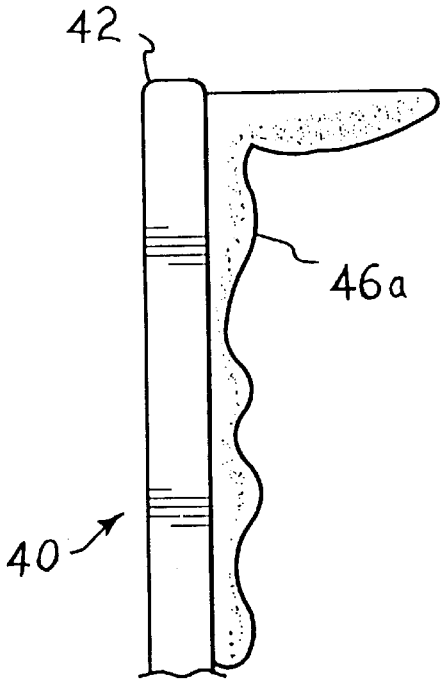
FIG. 2B is a top plan view of a leg restraint extension having a generally L-shaped or right angle brace with elongated padded section.
Figure 2C:
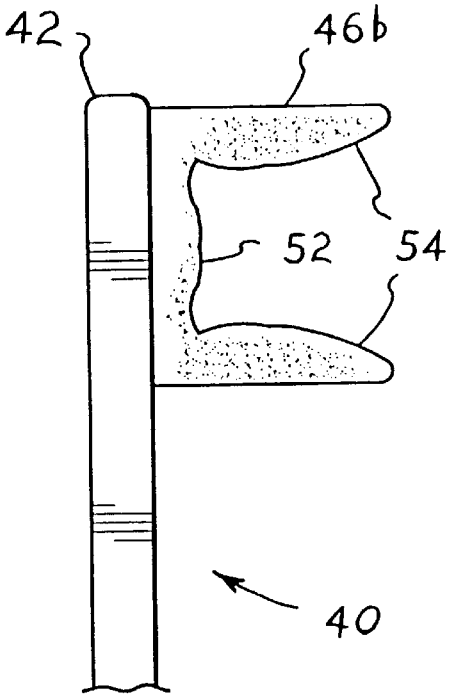
FIG. 2C is a top plan view of a leg restraint extension having a generally U-shaped padded brace.

Alternatively, a generally U-shaped padded brace 46*b* may be used, as shown for the left side brace 40 of FIG. 2C. The base 52 of the U-shape would be mounted to the inner surface of the forward end 42 of each extension 40, such that the legs 54 of the U-shape are at right angles to the arm 40. With this brace 46*b*, forward, rearward, and outward (lateral) movement of the legs of a patient are limited by the brace.

A further alternative comprising a sleeve-like brace 46*c* may be pivotally mounted on the inner surface of the forward end 42 of each arm 40, as shown in FIG. 2A. The sleeve-like brace 46*c* is adapted to accept the lower extremity of the patient through an open side. Once the extremity is engaged, the sleeve 46*c* is closed with a fastener 48 such as hook and loop type fasteners. This embodiment allows the brace to be attached to the patient at the lower thigh through to the ankle, with appropriate adjustment of the arms. Use of this type of brace is shown in FIGS. 3A and 3B.

Figure 4A:
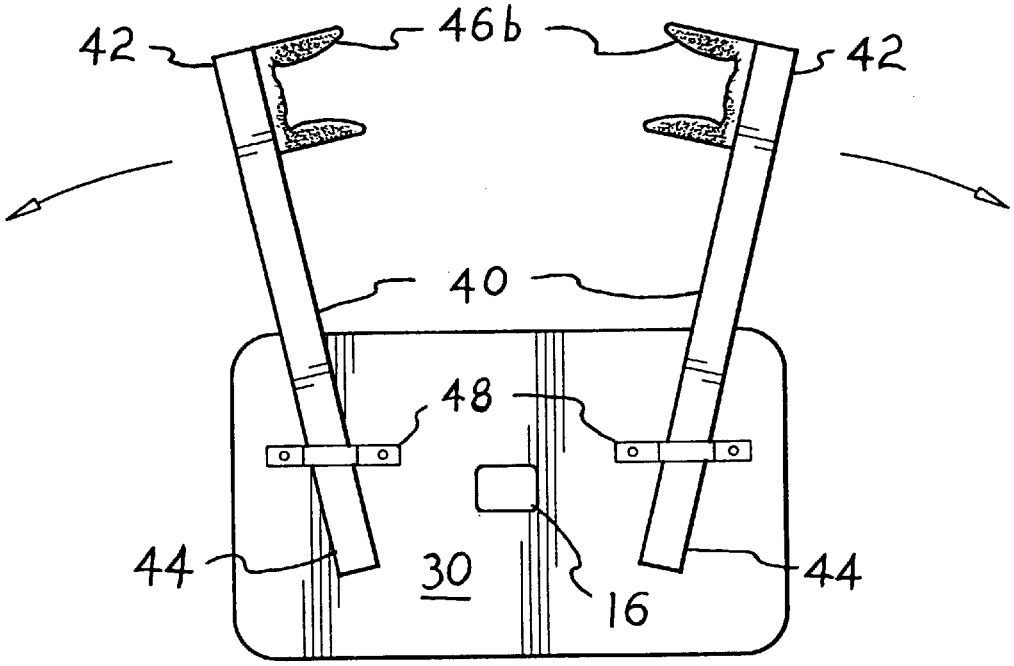
FIG. 4A is a bottom plan view of the underside of the present chiropractic adjusting chair, showing the two extensions with the U-shaped braces of FIG. 2C adjusted laterally outwardly from one another.
Figure 4B:
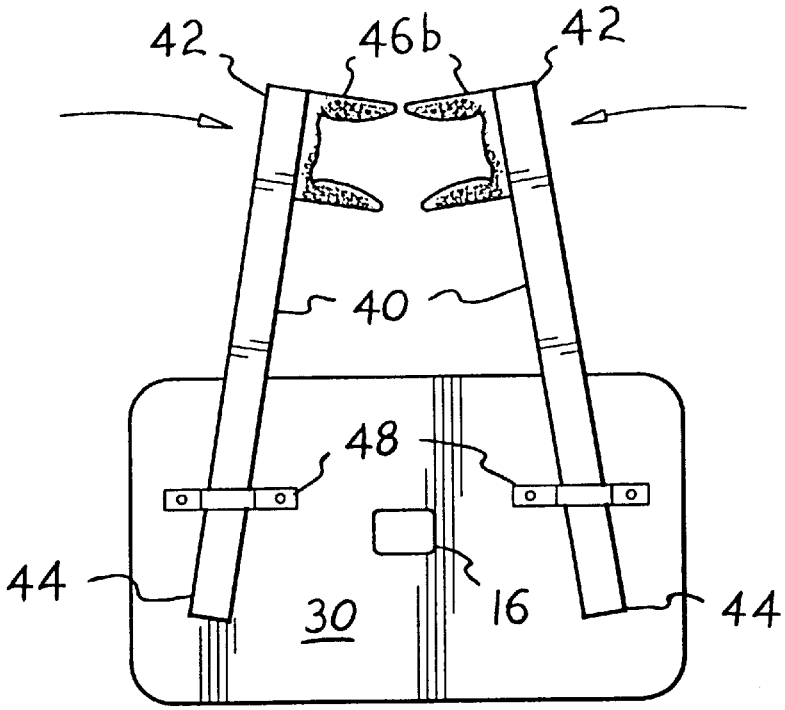
FIG. 4B is a bottom plan view of the underside of the present chiropractic adjusting chair, showing the two extensions of FIG. 4A adjusted toward one another.

FIGS. 4A and 4B illustrate bottom plan views of the present chair 1, showing means for adjusting the distal ends 42 of the two extension arms 40 arcuately inwardly and outwardly relative to one another. The two extensions 40 pass through retaining means 48 secured to the bottom of the seat portion 30, with the extension retaining means 48 providing some lateral arcuate freedom of movement for the two extensions 40. Conventional locking means, such as the locking means 50 disclosed in FIG. 1 for locking the longitudinal and arcuately vertical positions of the extension arms 40, may be used to secure the two extensions in the laterally arcuate locked position as desired within their respective retaining devices 48, depending upon the physiology or body build of the patient or person seated on the present chair 1, the particular therapeutic procedure to be accomplished, the needs of the chiropractor or other health care professional administering the treatment, etc.

Figure 3A:
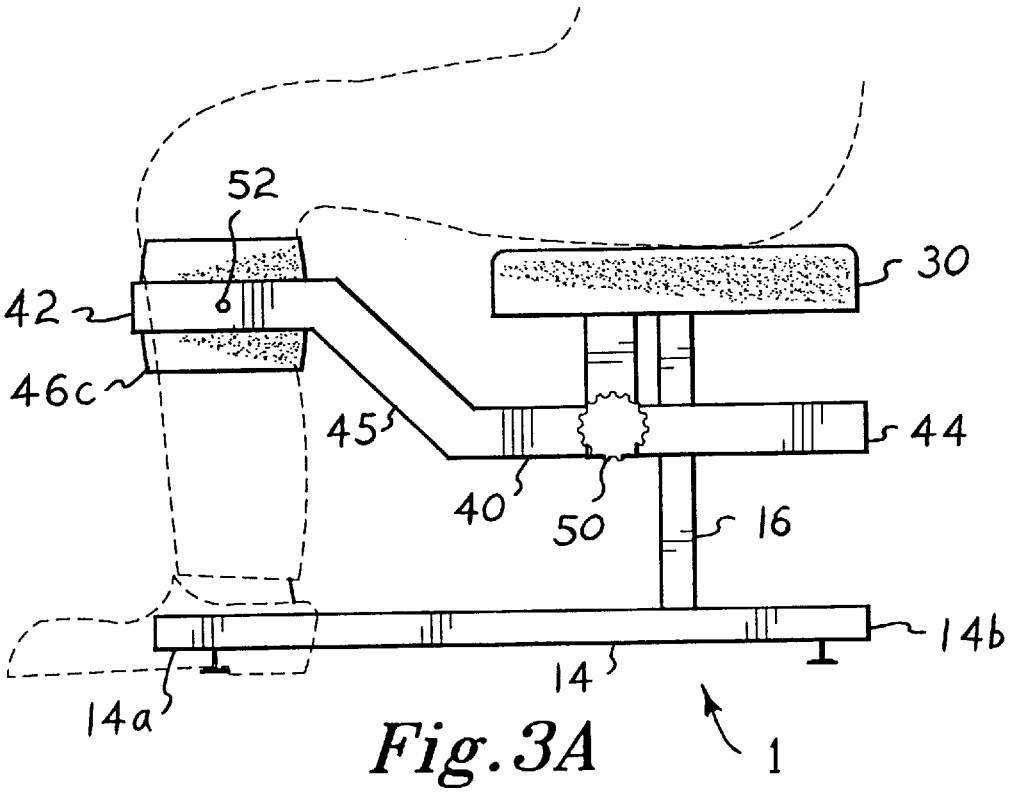
FIG. 3A is a side elevation view of the chiropractic adjusting chair of the present invention, showing an exemplary adjusting position for the extension and leg brace of FIG. 2A.
Figure 3B:
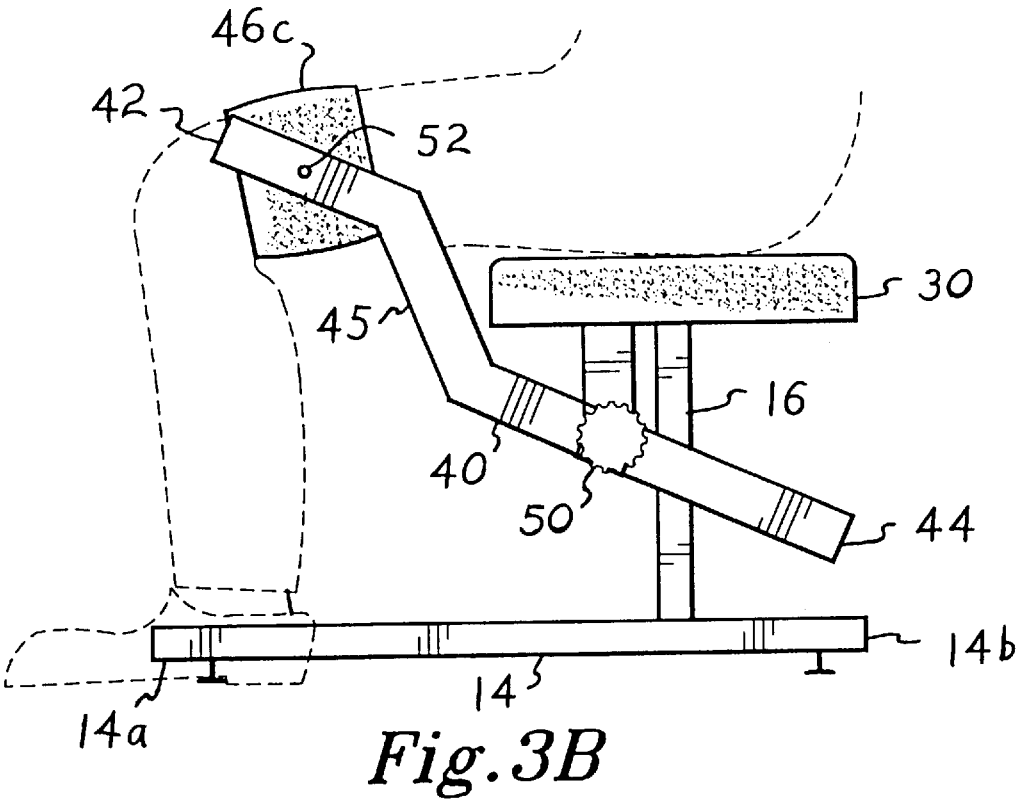
FIG. 3B is a side elevation view of an alternative position of the extension and leg brace of FIG. 3A.

FIGS. 3A and 3B illustrate left side elevation views of the present chair 1 in use, with a patient seated upon the seat portion 30 thereof. In FIG. 3A, the extension arms 40 are in a generally horizontal disposition (with the forward ends 42 being raised somewhat, due to the offset 45). The encircling leg band 46*c* brace embodiment is secured about the lower leg of the patient, at the upper portion of the calf and just below the knee. Locking or immobilizing the two extension arms 40 precludes any substantial lateral movement of the legs of the patient, thus allowing the medical practitioner or therapist to manipulate the back of the patient torsionally, without the lower body of the patient also twisting.

If further retention is required, the forward distal ends 42 of the extensions 40 may be raised and the extensions 40 may be moved rearwardly in their retaining collars or fixtures and locked in place by means of the locking knob or mechanism '50. This positions the two leg bands 46*c* (only the left band is shown in the side elevation view of FIG. 3B) adjacent the lower thighs of the patient seated in the present chair 1, immediately above the knee. It will be seen that the encircling braces 46*c* are secured to the distal ends 42 of the extensions 40 by means of pivots 52, so the encircling braces 46*c* may be turned so their axes are oriented generally horizontally (as shown in FIG. 3B) or vertically (as shown in FIG. 3A), as required. It will be seen that the other bracing means of FIGS. 2A and 2B may also be pivotally mounted to the distal ends 42 of the extensions 40, if so desired.

In use, the patient is seated comfortably on the chair with his or her legs on the forward side toward the distal ends of the extensions. With the patient's feet flat on the floor, the extension arms are then adjusted as necessary by the chiropractor to secure the patient's legs and thus the lower body to the degree dictated by the procedure being done. Use of the chair facilitates the chiropractor's ability to manipulate the vertebrae of the spine by substantially reducing or precluding rotation of the lower body. Regardless of the manipulation being done or the padded brace being used, the extensions of the chair hold the lower extremities of the patient in a predetermined position for the duration of the patient's treatment or until the chiropractor needs to alter the position. Equipped with the chair of the present invention and professional skills, the chiropractor or other health professional can make adjustments much more efficiently on the vertebrae of a patient, from the sacral and lumbar regions through the thoracic region of the spine, without any requirement for the patient to brace him or herself actively by wrapping his or her legs about the legs of the chair upon which he or she is seated, as is conventionally done. The present chair provides a much more secure means of precluding or substantially reducing accompanying movement of the patient's lower body when the upper torso is rotated, thus providing a considerable increase in efficiency of the procedure.

It is to be understood that the present invention is not limited to the sole embodiments described above, but encompasses any and all embodiments within the scope of the following claims.

We claim:

1. A chiropractic adjusting chair for generally precluding movement of the lower extremities of a patient seated thereon during chiropractic adjustment of the spine of the patient, comprising:

a base;

at least one seat support post extending upwardly from said base;

a seat disposed atop said seat support post, with said seat having opposed lateral edges; and an extension having a forward end and mounted beneath each of said edges of said seat and extending forwardly therefrom, for retaining and precluding movement of the lower extremities of a person seated upon said seat, each said forward end having an inner surface having a padded brace affixed thereto for cushioning the person's lower extremities being retained by each said extension, with each said padded brace being disposed in facing opposition to one another.

2. The chiropractic adjusting chair according to claim 1, wherein each said extension is adjustably secured to said seat.

3. The chiropractic adjusting chair as defined by claim 2, wherein each said extension is longitudinally adjustable and arcuately adjustable in vertical and horizontal planes.

4. The chiropractic adjusting chair as defined by claim 2, including a locking mechanism for securing each said extension in a fixed position relative to said seat as desired.

5. The chiropractic adjusting chair as defined by claim 4, wherein each said locking mechanism is operated by a control knob which is loosened for adjusting the corresponding said extension, and tightened for locking the corresponding said extension into position as desired.

6. The chiropractic adjusting chair as defined by claim 1, wherein each said padded brace comprises a generally L-shaped pad affixed to said inner surface of said forward end of each said extension, such that each said pad precludes significant forward and outward movement of the lower extremities of the person seated upon said seat.

7. The chiropractic adjusting chair as defined by claim 1, wherein each said padded brace comprises a padded sleeve with one selectively openable side for accepting one of the lower extremities of the person seated upon said seat, with said openable side having a fastener for selectively closing said padded sleeve about the lower extremity.

8. The chiropractic adjusting chair as defined by claim 7, wherein each said padded sleeve is pivotally secured to a corresponding said inner surface of each said forward end of each said extension.

9. The chiropractic adjusting chair as defined by claim 7, wherein said fastener for each said selectively openable sleeve comprises mating hook and loop fastening material.

10. The chiropractic adjusting chair as defined by claim 1, wherein each said padded brace comprises a generally U-shaped pad extending inwardly from a corresponding said forward end of each said extension, with each said U-shaped pad having a pair of opposed legs for placement forwardly and rearwardly of one of the lower extremities of a person seated upon said seat, for precluding forward and rearward movement of the extremity by means of said opposed legs of said brace and further precluding outward movement of the extremity by means of the corresponding said extension.

11. A chiropractic adjusting chair for generally precluding movement of the lower extremities of a patient seated thereon during chiropractic adjustment of the spine of the patient, comprising:

a base has a generally H-shaped structure having parallel, opposed first and second legs with a crossmember extending therebetween;

at least one seat support post extending upwardly from said base;

a seat disposed atop said seat support post, with said seat having opposed lateral edges; and an extension mounted beneath each of said edges of said seat and extending forwardly therefrom, for retaining and precluding movement of the lower extremities of a person seated upon said seat.

12. The chiropractic adjusting chair according to claim 11, wherein each said extension is adjustably secured to said seat.

13. The chiropractic adjusting chair as defined by claim 12, wherein each said extension is longitudinally adjustable and arcuately adjustable in vertical and horizontal planes.

14. The chiropractic adjusting chair as defined by claim 12, including a locking mechanism for securing each said extension in a fixed position relative to said seat as desired.

15. The chiropractic adjusting chair as defined by claim 14, wherein each said locking mechanism is operated by a control knob which is loosened for adjusting the corresponding said extension, and tightened for locking the corresponding said extension into position as desired.

16. The chiropractic adjusting chair as defined by claim 11, wherein said first and second legs each have a forward end and an opposite rearward end, with said crossmember being positioned closer to each said rearward end of said legs than to each said forward end of said legs.

17. The chiropractic adjusting chair as defined by claim 11, wherein said seat support post extends upwardly from said crossmember.

18. The chiropractic adjusting chair as defined by claim 1, wherein at least said base, said seat support, and each said extension are steel.

19. The chiropractic adjusting chair as defined by claim 1, wherein at least said base, said seat support post, and each said extension are tubes having square cross sections.

20. A chiropractic adjusting chair for generally precluding movement of the lower extremities of a patient seated thereon during chiropractic adjustment of the spine of the patient, comprising:

a base;

at least one seat support post extending upwardly from said base;

a seat disposed atop said seat support post, with said seat having opposed lateral edges; and an extension having a forward end and mounted beneath each of said edges of said seat and extending forwardly therefrom, for retaining and precluding movement of the lower extremities of a person seated upon said seat, said extension further having an offset for raising each said forward end generally level with said seat when said base is resting upon a level surface.

* * * * *